United States Patent [19]
Rhodin

[11] Patent Number: 4,480,590
[45] Date of Patent: Nov. 6, 1984

[54] BOILER HAVING A PUMPING EFFECT

[76] Inventor: Geran Rhodin, Vëlundsgatan 8, S113 21 Stockholm, Sweden

[21] Appl. No.: 305,646

[22] PCT Filed: Jan. 9, 1981

[86] PCT No.: PCT/SE81/00003
§ 371 Date: Sep. 18, 1981
§ 102(e) Date: Sep. 18, 1981

[87] PCT Pub. No.: WO81/02195
PCT Pub. Date: Aug. 6, 1981

[30] Foreign Application Priority Data
Jan. 21, 1980 [SE] Sweden ..... 8000478

[51] Int. Cl.³ ..... F22B 5/00
[52] U.S. Cl. ..... 122/13 R; 122/14; 122/15; 122/19; 122/155 A; 122/367 C
[58] Field of Search ..... 122/44 A, 136 C, 155 A, 122/166 R, 367 R, 367 A, 367 C, 367 PF, 235 L, 235 M, 14

[56] References Cited

U.S. PATENT DOCUMENTS

| | | | |
|---|---|---|---|
| 1,993,674 | 3/1935 | Larsen | 122/166 R |
| 2,910,119 | 10/1959 | Wennerberg | 122/4 R |
| 3,732,848 | 5/1973 | Bolin | 122/14 |
| 3,987,761 | 10/1976 | Downs et al. | 122/367 C |

FOREIGN PATENT DOCUMENTS 316277 10/1969 Sweden .

*Primary Examiner*—Edward G. Favors
*Assistant Examiner*—Steven E. Warner

[57] ABSTRACT

A boiler having a pumping effect comprises a casing (2) which includes an outer and an inner, annular liquid compartment (3 and 4, respectively) the outer of which has a greater extent in height than the inner one and which communicates with each other at the bottom. A supply pipe (5) is connected at the bottom to the outer liquid compartment, while at the top an outlet pipe (6) is connected to said outer liquid compartment, A heat source is adapted to act in a central through-going combustion chamber (7) to heat the inner walls (8), facing the combustion chamber, of the inner annular liquid compartment as well as that portion (9) of the outer, equally annular liquid compartment which extends above said inner compartment.

According to the invention an upper portion of a partition separating the outer and inner annular liquid compartments (3 and 4, respectively) is double and defines an annular space (10) open upwardly towards the combustion chamber, while a lower portion of the partition consists of a cylindrical screen (11). Further the wall of the inner liquid compartment (4) bordering on the combustion chamber (7) is provided with a number of rods (12) extending straight across the combustion chamber and being adapted to conduct to the wall the heat emitted from the heat source.

9 Claims, 1 Drawing Figure

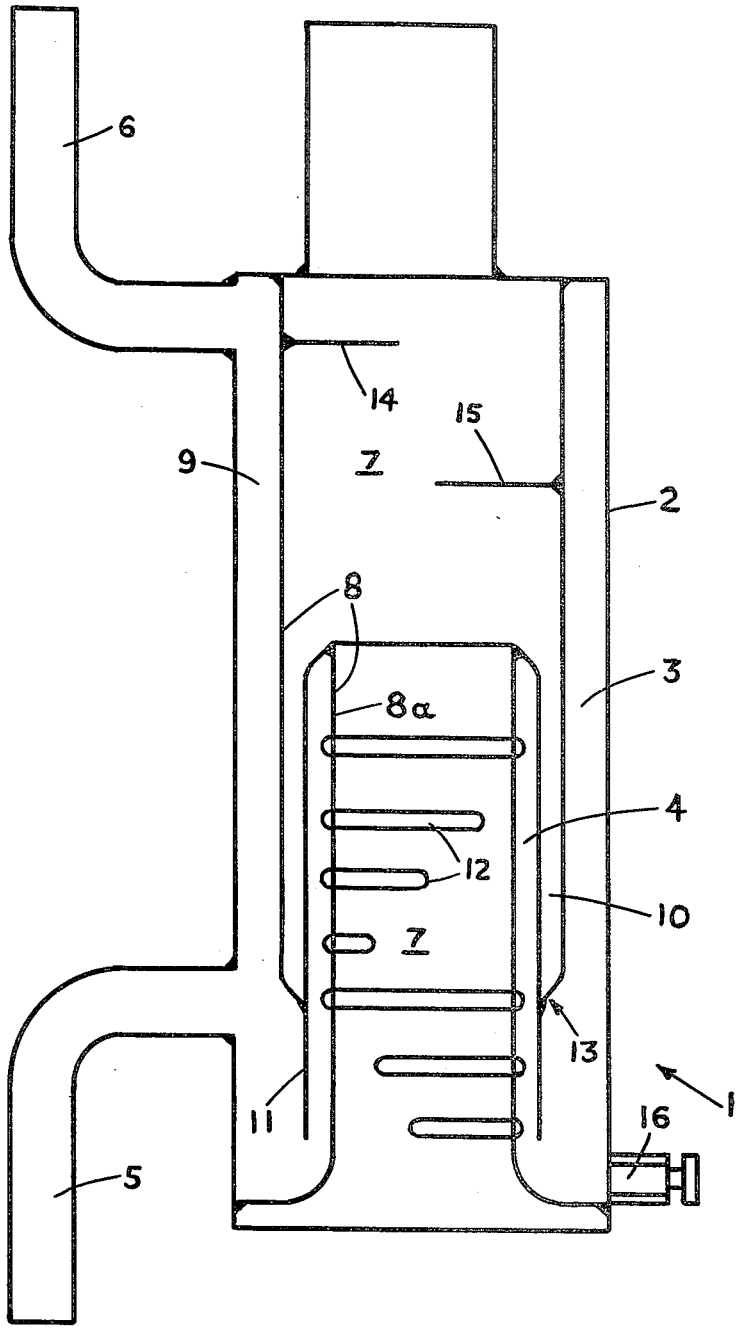
6
14
15
9
2
8
3
8a
4
12
10
13
1
11
16
5

BOILER HAVING A PUMPING EFFECT

The present invention relates to a boiler having a pumping effect, comprising a casing which includes an outer and an inner, annular liquid compartment the outer of which has a greater extent in height than the inner one and which communicate with each other at the bottom, and a supply pipe is connected at the bottom to the outer liquid compartment, while at the top an outlet pipe is connected to said outer liquid compartment and a heat source is adapted to act in a central through-going combustion chamber to heat the inner walls, facing the combustion chamber, of the inner annular liquid compartment as well as that portion of the outer, equally annular liquid compartment which extends above said inner compartment.

Boilers of this type (cf. eg. Swedish Pat. No. 316 277) are apt for use in heating systems for caravans, boats and the like and also as waterheaters. Of course the invention can be used also in other fields where water is to be heated up and brought to circulate in some way. Due to the pumping effect of the boiler, which is obtained by co-operation of the inner and outer annular liquid compartments, no separate pump is required and thus not either any form of electricity, since the boiler is driven by means of gas especially but of course other fuels can also be used. Besides, the ignition of the fuel is effected for instance by piezo-electrical means.

The disadvantage of prior art boilers is that their efficiency is low. Considering the energy costs a boiler of the type mentioned above will thus not be quite economical in use.

The object of the present invention is to provide a boiler of the above-mentioned type having a substantially improved efficiency as compared to prior art boilers of this type.

This object is achieved in that an upper portion of a partition separating the outer and inner annular liquid compartments is double and defines an annular space open upwardly towards the combustion chamber, while a lower portion of the partition consists of a cylindrical screen, and in that the wall of the inner liquid compartment bordering on the combustion chamber is provided with a number of rods extending straight across the combustion chamber and being adapted to conduct to the wall the heat emitted from the heat source.

The invention will be described more in detail below with reference to the accompanying drawing which shows a cross-section of a preferred embodiment of a boiler according to the invention.

A boiler 1 with a pumping effect according to the invention comprises a casing 2 which includes an outer and an inner, annular liquid compartment 3 and 4, respectively, of which the outer one has a greater extent in height than the inner one and which communicate with each other at the bottom. At the bottom a supply pipe 5 is connected to the outer liquid compartment 3, while at the top an outlet pipe 6 is connected to the outer liquid compartment 3. A heat source (not shown) is adapted to act in a central through-going combustion chamber 7 to heat the inner walls 8, facing the combustion chamber, of the inner annular compartment 4 as well as that portion 9 of the outer, equally annular liquid compartment 3 which extends above said compartment 4.

An upper portion of a partition separating the outer and inner, annular liquid compartments 3 and 4 is double and defines an annular space 10 open upwardly towards the combustion chamber 7, while a lower portion of the partition consists of a cylindrical screen 11. The wall **8*a* of the inner liquid compartment 4 bordering on the combustion chamber is provided with a number of rods 12** extending straight across the combustion chamber and being adapted to conduct to the wall the heat emitted from the heat source.

In the preferred embodiment the rods 12 are horizontally directed above each other in the longitudinal direction of the combustion chamber 7. The rods are helically arranged and spaced apart at substantially equal distance from each other in the longitudinal direction of the combustion chamber. The rods of the boiler according to the drawing are cylindrical in cross-section but they may of course also have other cross-sections within the scope of the invention. All or part of the rods may also be of tubular shape.

In the preferred embodiment the supply pipe 5 is connected to the outer annular liquid compartment 3 at the level (at 13) where the screen 11 merges in the annular space 10. Practical experiments have proved that this positioning of the supply pipe gives optimum efficiency to the boiler.

Two baffle plates 14 and 15 are arranged in axially staggered relationship on either side of the combustion chamber in that part which is defined by the upwardly projecting portion 9 of the outer annular liquid compartment 3. One baffle plate 14 is preferably positioned on the same side as the outlet pipe 6 and is substantially aligned with the lower edge of said outlet pipe; see the drawing FIGURE. From practical experiments it has been found that this positioning of the first baffle plate will give optimum efficiency to the boiler. The other baffle plate 15 is situated above the inner annular liquid compartment 4 and is positioned on that side of the upper portion of the combustion chamber which is opposite to the first baffle plate 14. If it is found necessary it is of course possible to arrange more baffle plates in the upper portion of the combustion chamber but the number of baffle plates should not be less than two as is the case with the preferred embodiment.

A drain valve 16 is mounted on the outer annular liquid compartment 3, at the very bottom thereof. This drain valve is to be used when the boiler serves as a water-heater in boats, caravans or the like. Before the temperature decreases below zero, for instance during the winter season, the remaining water must be drawn off from the outer annular liquid compartment. Normally such drain valves are not required when the boiler is used in spaces where the temperature never is below 0° C.

The invention may of course be modified within the scope of the appended claims.

I claim:

1. A boiler having a pumping effect, comprising a casing (2) which includes an outer and an inner annular liquid compartment (3 and 4, respectively) the outer of which has a greater extent in height than the inner one and which communicate with each other at the bottom, and a supply pipe (5) connected at the bottom to the outer liquid compartment, at the top an outlet pipe (6) connected to said outer liquid compartment and a central through-going combustion chamber (7) to heat the inner walls (8), facing the combustion chamber, of the inner annular liquid compartment as well as that portion (9) of the outer, equally annular liquid compartment which extends above said inner compartment, said boiler further comprising partition means for separating the outer and inner annular liquid compartment (3 and 4 respectively), said partition means defining an annular space (10) between said outer and said inner compartments opening upwardly towards the combustion chamber, their being a cylindrical screen (11) depending from the partition into said bottom and wherein the wall of the inner liquid compartment (4) bordering on the combustion chamber (7) is provided with a number of rods (12) extending straight across the combustion chamber and being adapted to conduct to the wall the heat emitted from the combustion chamber, said supply pipe communicating with said outer compartment at the upper edge of said cylindrical screen to provide said pumping effect.

2. A boiler as claimed in claim 1, wherein the rods (12) are horizontally directed above each other in the longitudinal direction of the combustion chamber (7).

3. A boiler as claimed in claim 1, wherein the rods (12) are horizontally and helically arranged and spaced apart at substantially equal distances from each other in the longitudinal direction of the combustion chamber (7).

4. A boiler as claimed in any one of claims 1–3 wherein each of the rods (12) is cylindrical in cross-section.

5. A boiler as claimed in any one of claims 1–3 wherein the connection of the supply pipe (5) to the outer annular liquid compartment (3) is at the level where the screen (11) merges in the annular space (10).

6. A boiler as claimed in any one of claims 1–3 further comprising at least two baffle plates (14,15) arranged in axially staggered relationship on opposite sides of the combustion chamber (7) in that part of the combustion chamber defined by the upwardly projecting portion of the outer annular liquid compartment (3).

7. A boiler as claimed in claim 6, including a first one of the baffle plates, namely, baffle plate (14) situated on the same side as the outlet pipe (6) and substantially aligned with the lower edge of said outlet pipe.

8. A boiler as claimed in claim 7 including a second one of the baffle plates, namely, baffle plate (15) situated above the inner annular liquid compartment (4) and positioned on that side of the upper portion of the combustion chamber (7) opposite to the first baffle plate (14).

9. A boiler as claimed in any one of claims 1–3 including a drain valve (16) mounted on the lowermost part of the outer annular liquid compartment (3).

* * * * *